US008907759B2

(12) United States Patent
Moiseev

(10) Patent No.: US 8,907,759 B2
(45) Date of Patent: Dec. 9, 2014

(54) MAGNETIC CORE AND INDUCTION DEVICE

(71) Applicant: Kabushiki Kaisha Toyota Jidoshokki, Aichi-ken (JP)

(72) Inventor: Sergey Moiseev, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 147 days.

(21) Appl. No.: 13/649,501

(22) Filed: Oct. 11, 2012

(65) Prior Publication Data

US 2013/0093561 A1 Apr. 18, 2013

(30) Foreign Application Priority Data

Oct. 18, 2011 (JP) ..... 2011-229130

(51) Int. Cl.
*H01F 17/04* (2006.01)

(52) U.S. Cl.
USPC ..... 336/221

(58) Field of Classification Search
USPC ..... 336/221–222, 212, 200, 232–234
See application file for complete search history.

(56) References Cited

U.S. PATENT DOCUMENTS

| | | | | |
|---|---|---|---|---|
| 4,391,494 | A | 7/1983 | Hershel | |
| 4,415,841 | A | 11/1983 | Willis et al. | |
| 4,425,037 | A | 1/1984 | Hershel et al. | |
| 5,313,176 | A * | 5/1994 | Upadhyay | 333/181 |
| 5,315,279 | A | 5/1994 | Ito et al. | |
| 6,211,765 | B1 | 4/2001 | Ito et al. | |
| 6,980,077 | B1 | 12/2005 | Chandrasekaran et al. | |
| 7,679,482 | B2 * | 3/2010 | Yamada et al. | 336/212 |
| 2004/0080978 | A1 | 4/2004 | Jitaru | |
| 2005/0012582 | A1 | 1/2005 | Sutardja | |
| 2005/0012583 | A1 | 1/2005 | Sutardja | |
| 2005/0012586 | A1 | 1/2005 | Sutardja | |
| 2005/0024179 | A1 | 2/2005 | Chandrasekaran et al. | |
| 2006/0082430 | A1 | 4/2006 | Sutardja | |
| 2006/0114091 | A1 | 6/2006 | Sutardja | |
| 2006/0114093 | A1 | 6/2006 | Sutardja | |
| 2006/0158297 | A1 | 7/2006 | Sutardja | |
| 2006/0158298 | A1 | 7/2006 | Sutardja | |
| 2006/0158299 | A1 | 7/2006 | Sutardja | |

(Continued)

FOREIGN PATENT DOCUMENTS

| | | |
|---|---|---|
| DE | 3307776 | 9/1984 |
| DE | 3842885 | 4/1990 |

(Continued)

OTHER PUBLICATIONS

Japanese Office action, mail date is Nov. 19, 2013.

(Continued)

*Primary Examiner* — Tuyen Nguyen
(74) *Attorney, Agent, or Firm* — Greenblum & Bernstein, P.L.C.

(57) ABSTRACT

A magnetic core includes a first core and a second core, which is formed of material having a lower magnetic permeability and a higher saturation magnetic flux density than those of the first core. The second core forms a closed magnetic path together with the first core. The second core has a distal surface held in contact with the first core. The area of the distal surface is larger than the smallest cross-sectional area of the second core in a direction perpendicular to the flow direction of magnetic flux in the closed magnetic path.

5 Claims, 2 Drawing Sheets

(56) References Cited

U.S. PATENT DOCUMENTS

| | | | |
|---|---|---|---|
| 2007/0163110 | A1 | 7/2007 | Sutardja |
| 2007/0171019 | A1 | 7/2007 | Sutardja |
| 2007/0261231 | A1 | 11/2007 | Bosley et al. |
| 2012/0200382 | A1 | 8/2012 | Hejny |

FOREIGN PATENT DOCUMENTS

| | | |
|---|---|---|
| DE | 3248293 | 11/1991 |
| EP | 0123826 | 11/1984 |
| EP | 2463869 | 6/2012 |
| GB | 2458476 | 9/2009 |
| JP | 02-290005 | 11/1990 |
| JP | 8-64428 | 3/1996 |
| JP | 11-040430 | 2/1999 |
| JP | 2005-039229 | 2/2005 |
| JP | 2007-013042 | 1/2007 |
| JP | 2007-088340 | 4/2007 |
| JP | 2007-95914 | 4/2007 |
| JP | 2007-128951 | 5/2007 |
| JP | 2009-027007 | 2/2009 |

OTHER PUBLICATIONS

U.S. Appl. No. 13/649,606 to Sergey Moiseev et al., filed Oct. 11, 2012.
Germany Office action, mail date is Apr. 17, 2013.
Japanese Office action, mail date is Aug. 27, 2013.

* cited by examiner

MAGNETIC CORE AND INDUCTION DEVICE

BACKGROUND OF THE INVENTION

The present invention relates to a magnetic core and an induction device having the magnetic core.

Induction devices such as reactors or transformers, which are configured by winding a coil around a magnetic core, are conventional. Some of such induction devices have a magnetic core employing a ferrite core and a dust core in combination. See, for example, Japanese Laid-Open Patent Publication No. 2007-95914.

A core described in the aforementioned document includes an E-shaped core having three magnetic legs and a flat plate-like I-shaped core having a pair of cutout portions. Two of the magnetic legs arranged at opposite ends of the E-shaped core are joined to the cutout portions of the I-shaped core.

In the above-described core, if the I-shaped core is formed using a ferrite core and the E-shaped core, around which a coil is wound, is formed by a dust core, the cross-sectional area of a portion where the coil is wound and the winding length of the coil are expected to be reduced. However, if each of the magnetic legs of the dust core contacts the ferrite core by a small contact area, magnetic flux saturation may occur in a portion of the ferrite core that contacts the dust core. This may make it impossible to obtain desirable direct current superimposing characteristics.

To solve this problem, in the core described in the aforementioned document, the distal surface and the corresponding side surface of each of the magnetic legs of the dust core may be held in contact with the corresponding one of the cutout portions to increase the contact area between the magnetic leg and the cutout portion. However, when the two magnetic legs are joined to the cutout portions as in the case of the aforementioned document, the interval between the magnetic legs must be greater than the interval between the cutout portions to facilitate mounting the dust core. This makes it difficult to hold the distal surfaces and the side surfaces of all the magnetic legs in contact with the ferrite core in the above-described document. As a result, it remains impossible to ensure a sufficiently large contact area between the cores.

SUMMARY OF THE INVENTION

Accordingly, it is an objective of the present invention to provide a magnetic core that improves direct current superimposing characteristics by ensuring a sufficiently large contact area between cores, and an induction device having the magnetic core.

To achieve the foregoing objective and in accordance with a first aspect of the present invention, a magnetic core is provided that includes a first core and a second core formed of a material having a lower magnetic permeability and a higher saturation magnetic flux density than those of the first core. The second core forms a closed magnetic path together with the first core. The second core has a distal surface held in contact with the first core. The area of the distal surface is larger than the smallest cross-sectional area of the second core in a direction perpendicular to a flow direction of a magnetic flux in the closed magnetic path.

In accordance with a second aspect of the present invention, an induction device is provided that includes the magnetic core of the first aspect and a core wound about the second core member.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS (First Embodiment)

A magnetic core and an induction device according to one embodiment of the present invention will now be described with reference to FIGS. 1 and 2.

Figure 1:
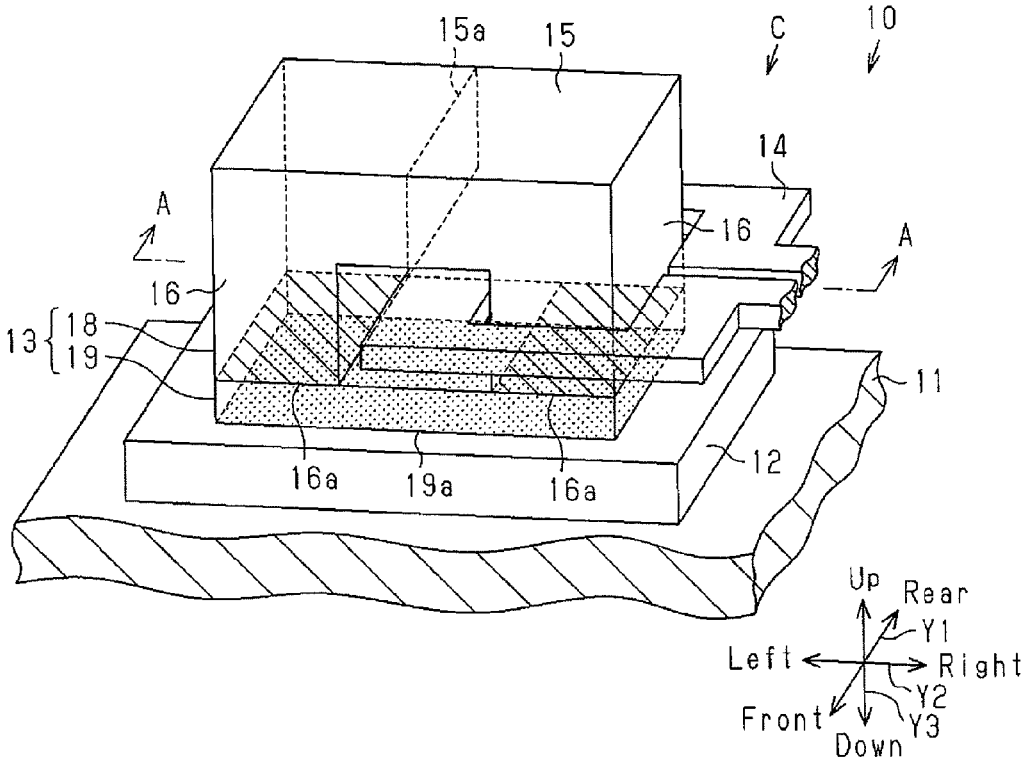
FIG. 1 is a perspective view schematically showing a magnetic core and a reactor according to a first embodiment of the present invention.

As shown in FIG. 1, a reactor 10, which serves as an induction device, is fixed to a heat dissipating plate 11, which is formed of, for example, aluminum. For illustrative purposes in the description below, the direction represented by arrow Y1, which is parallel to the heat dissipating plate 11, is defined as the front-rear direction. The direction represented by arrow Y2, which is parallel to the heat dissipating plate 11 and perpendicular to the direction of arrow Y1, is defined as the left-right direction or the lateral direction. The direction represented by arrow Y3, which is perpendicular to the heat dissipating plate 11, is defined as the up-down direction or the vertical direction.

The reactor 10 includes a first core 12 and a second core 13, and a coil 14 wound around the second core 13. The first core 12 is fixed to the upper surface of the heat dissipating plate 11 using, for example, adhesive. The second core 13 is mounted on the first core 12 from above. The first core 12 and the second core 13 form a magnetic core C.

The first core 12 is a ferrite core formed of ferrite such as MnZn based material or NiMn based material. The first core 12 is an I-shaped core, which is shaped like a flat rectangular plate as a whole, extending in the lateral direction as viewed from above. As shown in FIG. 2, the lower surface of the first core 12 is a contact surface 12*a* held in contact with the heat dissipating plate 11.

With reference to FIG. 1, the second core 13 is a dust core (a powder core) formed through pressure molding using powder (dust material) of magnetic material such as Fe—Al—Si based material having surfaces coated with insulating plastic material. The dust material forming the second core 13 has lower magnetic permeability and higher saturation magnetic flux density than those of ferrite.

The second core 13 includes a first core member 18, which substantially has an inverted U shape as viewed from the front, and a second core member 19, which is arranged below the first core member 18. The first core member 18 has a flat portion 15 and a pair of leg portions 16, each of which is shaped like a rectangular pillar. The flat portion 15 is shaped like a flat rectangular plate extending in the lateral direction as viewed from above and extends parallel to the first core 12.

The two leg portions 16 extend downward from opposite lateral peripheral end portions (opposite end portions) of the flat portion 15. The leg portions 16 each extend perpendicular to the contact surface 12*a* (the heat dissipating plate 11) and project toward (downward to) the first core 12 (the contact surface 12*a*). In other words, the first core member 18 is formed by bending opposite ends of a flat plate-like component downward each at a right angle.

The cross-sectional area of each of the leg portions 16 in a direction perpendicular to the vertical direction is smaller than the cross-sectional area of the first core 12 in a direction perpendicular to the lateral direction. The area of a cross section 15*a* of the flat portion 15 at the longitudinal (lateral) middle of the flat portion 15 is smaller than the cross-sectional area of the first core 12 in the direction perpendicular to the lateral direction. The area of an end surface 16*a* of each leg portion 16 is equal to the cross-sectional area of the leg portion 16 in the direction perpendicular to the vertical direction. The area of the cross section 15*a* of the flat portion 15 is equal to the aforementioned cross-sectional area of each leg portion 16.

The second core member 19 extends in the lateral direction as viewed from above. The second core member 19 is formed by a component independent from the first core member 18 and shaped like a flat rectangular plate. The second core member 19 is shaped in correspondence with, or, in other words, identically to, the outline of the first core member 18, as viewed from above. The second core member 19 is fixed to the upper surface of the first core 12 using, for example, adhesive. A lower surface 19*a* of the second core member 19 is held in contact with the upper surface of the first core 12.

The cross-sectional area of the second core member 19 in the direction perpendicular to the vertical direction (the area of the second core member 19 as viewed from above) is larger than both the cross-sectional area of each leg portion 16 in the direction perpendicular to the vertical direction and the area of the cross section 15*a* of the flat portion 15. The end surfaces 16*a* of the leg portions 16 of the first core member 18 are held in contact with the upper surface of the second core member 19. The area of the contact portion (indicated by the dotted area in FIG. 1) between the lower surface 19*a* of the second core member 19 and the first core 12 is larger than the area of each of the contact portions (indicated by the cross-hatched areas in the drawing) between the end surfaces 16*a* of the leg portions 16 and the second core member 19.

As has been described, the second core member 19 is a single component arranged between all the leg portions 16 of the first core member 18 and the first core 12. The lower surface 19*a* of the second core member 19, which contacts the first core 12, corresponds to the distal surface of the second core 13. The second core 13 is formed by combining the first core member 18 and the second core member 19 with each other and thus has a rectangular frame-like shape (a rectangular loop shape) as viewed from the front. Likewise, the magnetic core C is formed by combining the first core 12 and the second core 13 (the first core member 18 and the second core member 19) with each other and thus has a rectangular frame-like shape (a rectangular loop shape) as viewed from the front.

In the first core member 18, a coil 14 is wound around one of the two leg portions 16. In other words, the first core member 18 is assembled to the first core 12 and the second core member 19 with one of the leg portions 16 passed through the coil 14. The coil 14 is wound (turned) one turn. In the first embodiment, the corresponding leg portion 16 of the first core member 18 corresponds to the winding portion for the coil 14.

A method for forming, or manufacturing, the reactor 10 will hereafter be described.

First, the second core member 19 is fixed to the upper surface of the first core 12 using fixing means such as adhesive. The first core 12, to which the second core member 19 fixed, is then fixed to the upper surface of the heat dissipating plate 11 using fixing means such as adhesive. Subsequently, the coil 14 is mounted in correspondence with one of the leg portions 16 of the first core member 18 at a position above the second core member 19. The coil 14 is then fixed.

Next, the first core member 18 is assembled to the second core member 19 (the first core 12) from above, while passing the corresponding leg portion 16 through the coil 14. The first core member 18 is fixed to the second core member 19 with the upper surface of the second core member 19 held in contact with the end surfaces 16*a* of the leg portions 16. As a result, the magnetic core C and the reactor 10 are completed.

Operation of the reactor 10 will now be described.

Figure 2:
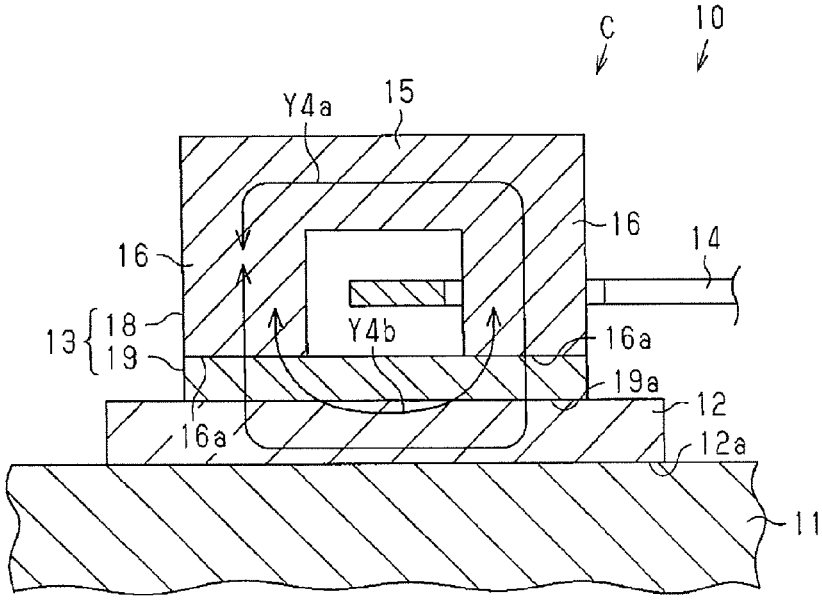
FIG. 2 is a cross-sectional view taken along line A-A in FIG. 1.

In the first embodiment, when the coil 14 receives electric power, the reactor 10 forms a closed magnetic path, in which magnetic flux flows through one of the leg portions 16, the flat portion 15, the other leg portion 16, the second core member 19, the first core 12, the second core member 19, and the leg portion 16 in that order or in the reversed order, as indicated by arrows Y4*a*, Y4*b* in FIG. 2. In other words, the second core 13 forms the closed magnetic path together with the first core 12. The leg portions 16 of the first core member 18 each function as a magnetic leg that extends (vertically) toward the first core 12 and forms a part of the closed magnetic path.

The cross-sectional area of the flat portion 15 and the cross-sectional area of each leg portion 16 in the first core member 18 in a direction perpendicular to the flow direction of the magnetic flux in the closed magnetic path are each smaller than the cross-sectional area of the first core 12 in the direction perpendicular to the flow direction of the magnetic flux in the closed magnetic path. The area of the lower surface 19*a* of the second core member 19 is larger than the cross-sectional area of the flat portion 15 in the direction perpendicular to the flow direction of the magnetic flux in the closed magnetic path, than the cross-sectional area of each leg portion 16, and also than the area of the end surface 16*a*. In other words, the area of the lower surface 19*a* of the second core member 19 is larger than the smallest cross-sectional area the second core 13 in the direction perpendicular to the flow direction of the magnetic flux in the closed magnetic path.

As a result, the magnetic flux not only proceeds in the direction perpendicular to the end surfaces 16*a* of the leg portions 16, as indicated by arrow Y4*a*, but also spreads through the end surfaces 16*a* to laterally inner positions in the leg portions 16, as indicated by arrow Y4*b*. In other words, the magnetic flux moving from the first core 12 to the leg portions 16 is prevented from being concentrated in the first core 12.

As a result, unlike a configuration in which the end surfaces 16*a* of the leg portions 16 contact the first core 12 without the second core member 19 arranged in between, magnetic flux saturation is prevented from occurring in the contact portion between the first core 12, which is formed of ferrite, and the second core 13. In other words, the second core member 19 functions as an enlarging portion for increasing the contact area with respect to the first core 12 compared to the contact area with respect to each end surface 16*a*.

Since the second core member 19 is formed of dust material, it is easier for the generated magnetic flux to proceed through the second core member 19 in the vertical direction as indicated by arrows Y4*a*, Y4*b* than in the lateral direction. However, if the magnetic flux saturates in the first core 12, the magnetic flux flows laterally in the second core member 19 to prevent saturation of the magnetic flux in the magnetic core C as a whole. That is, the second core member 19 forms an auxiliary magnetic path between the two leg portions 16 of the first core member 18.

The first embodiment has the advantages described below.

(1) The area of the lower surface 19*a* of the second core member 19 of the second core 13 is larger than the smallest cross-sectional area of the second core 13 in the direction perpendicular to the flow direction of the magnetic flux in the closed magnetic path. This increases the contact area between the lower surface 19*a* of the second core member 19 and the first core 12. In other words, a sufficiently large contact area is ensured between the cores 12, 13 to obtain desirable direct current superimposing characteristics.

(2) The second core 13 has the first core member 18, which has the two leg portions 16, and the second core member 19, which is arranged between the leg portions 16 and the first core 12. This configuration facilitates handling of the second core 13, compared to a configuration in which the first and second core members 18, 19 are formed integrally with each other. The area of the lower surface 19*a* of the second core member 19 is larger than the contact area between the end surface 16*a* of each leg portion 16 and the second core member 19. The contact area between the first core 12 and the second core 13 is thus larger than that in a configuration without a second core member 19 arranged between the cores 12, 13. This improves the direct current superimposing characteristics.

(3) The second core member 19, which is formed by a single component, is arranged between all of the leg portions 16 and the first core 12. The second core member 19 thus increases the contact area between each leg portion 16 and the first core 12. As a result, the number of components is reduced, and the manufacture is facilitated.

(4) The second core member 19, which is fixed to the first core 12, is shaped like a flat plate. The coil 14 is mounted in correspondence with one of the leg portions 16 at a position above the second core member 19. This prevents the mounting position of the coil 14 from being restricted to a specific position due to the shape of the second core member 19, unlike a case in which the second core member 19 is formed in, for example, a U shape or an E shape, as viewed from the front. As a result, the coil 14 is mounted easily. After the coil 14 is mounted, the corresponding leg portion 16 is passed through the coil 14 and, meanwhile, the first core member 18 is mounted. The first core member 18 is thus easily assembled.

(5) The end surfaces 16*a* of the leg portions 16 of the first core member 18 are held in contact with the upper surface of the second core member 19. As a result, if the magnetic flux saturates in the first core 12, the magnetic flux proceeds laterally in the second core member 19, thus preventing saturation of the magnetic flux in the magnetic core C as a whole.

(Second Embodiment)

A magnetic core and an induction device according to a second embodiment of the present invention will now be described with reference to FIGS. 3 and 4. The same or like reference numerals are given to components of the second embodiment that are the same as or like the corresponding components of the first component. Repeated description of these components are omitted or simplified herein. For illustrative purposes, the coil 14 is not illustrated in FIG. 3.

Figure 3:
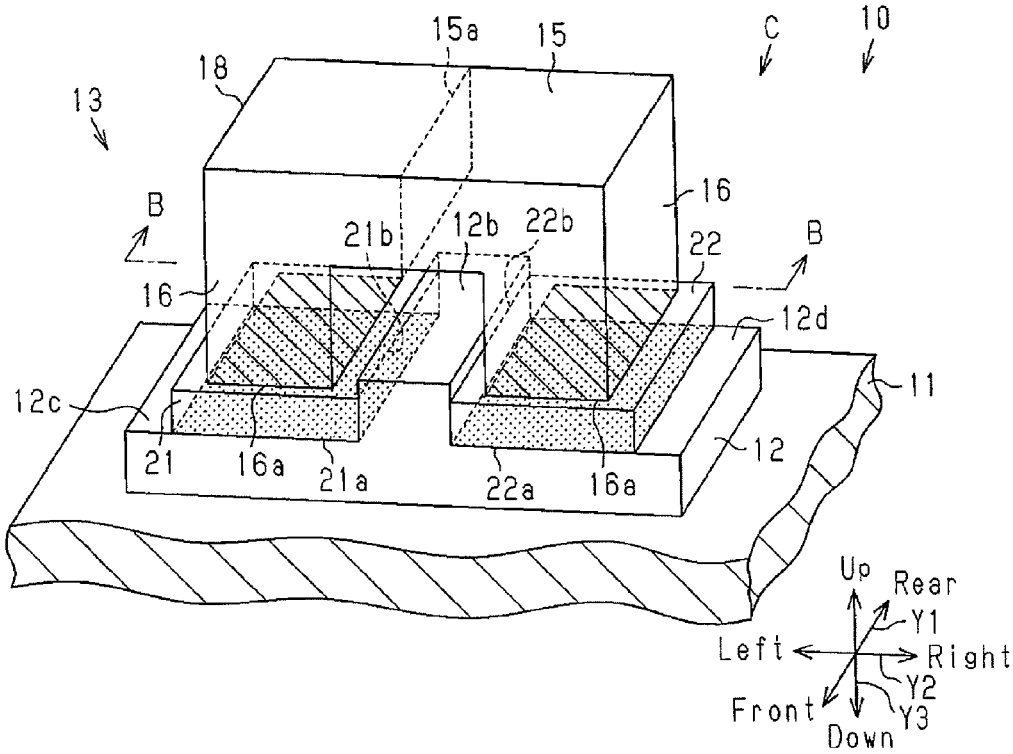
FIG. 3 is a perspective view schematically showing a magnetic core and a reactor according to a second embodiment of the invention.

As illustrated in FIG. 3, a first step 12*c* and a second step 12*d* are formed at opposite lateral sides of the first core 12 by cutting corresponding upper portions of the first core 12 downward from the positions corresponding to the upper surface of the first core 12. In other words, a wall portion 12*b*, which is shaped substantially as a rectangular parallelepiped, is formed at the lateral middle of the upper surface of the first core 12 along the full width in the front-rear direction and projects vertically.

In the second embodiment, the second core member 19 of the first embodiment is replaced by a second core member 21 and a second core member 22. The second core members 21, 22 each have a flat rectangular plate-like shape as viewed from above. The second core member 21 is fixed to the first step 12*c* using, for example, adhesive. A lower surface 21*a* of the second core member 21 is held in contact with the upper surface of the first core 12 (the bottom surface of the first step 12*c*). A right side surface 21*b* of the second core member 21 contacts the right side surface of the first step 12*c* (the left side surface of the wall portion 12*b*).

The second core member 22 is fixed to the second step 12*d* using, for example, adhesive. A lower surface 22*a* of the second core member 22 is held in contact with the upper surface of the first core 12 (the bottom surface of the second step 12*d*). A left side surface 22*b* of the second core member 22 contacts the left side surface of the second step 12*d* (the right side surface of the wall portion 12*b*).

The cross-sectional area of each of the second core members 21, 22 in the direction perpendicular to the vertical direction (the area of each second core member 21, 22 as viewed from above) is larger than both the cross-sectional area of each leg portion 16 in the direction perpendicular to the vertical direction and the area of the cross section 15*a* of the flat portion 15.

The end surface 16*a* of the left one of the leg portions 16 of the first core member 18 contacts the upper surface of the second core member 21. The end surface 16*a* of the right one of the leg portions 16 contacts the upper surface of the second core member 22. The sum of the area of the contact portion (represented by a dotted area in FIG. 3) between the lower surface 21*a* of the second core member 21 and the first step 12*c* of the first core 12 and the area (represented by a dotted area in the drawing) between the lower surface 22*a* of the second core member 22 and the second step 12*d* is larger than the sum of the area of the contact portion (represented by a cross-hatched area in the drawing) between the end surface 16*a* of the leg portion 16 and the second core member 21 and the area of the contact portion (represented by a cross-hatched area in the drawing) between the end surface 16*a* and the second core member 22.

As has been described, each of the second core members 21, 22 is arranged between the corresponding one of the leg portions 16 and the first core 12. The lower surface 21*a* and the lower surface 22*a* correspond to the distal surface of the second core 13.

A method for forming, or, in other words, manufacturing, the reactor 10 will hereafter be described.

First, with the lower surface 21*a* and the right side surface 21*b* held in close contact with the first core 12 (the first step 12*c*), the second core member 21 is fixed to the first step 12*c* of the first core 12 using fixing means such as adhesive. Similarly, with the lower surface 22*a* and the left side surface 22*b* held in close contact with the first core 12 (the second step 12*d*), the second core member 22 is fixed to the second step 12*d* of the first core 12 using fixing means such as adhesive.

Subsequently, the first core 12 is fixed to the upper surface of the heat dissipating plate 11 using fixing means such as adhesive. The coil 14 is then mounted at the position corresponding to the second core member 22 from above the second core member 22 (the first core 12) and fixed. Next, one of the leg portion 16 is passed through the coil 14 and, meanwhile, the first core member 18 is assembled to the second core members 21, 22 from above the second core members 21, 22 (the first core 12). With the upper surfaces of the second core members 21, 22 held in contact with the end surfaces 16*a* of the corresponding leg portions 16, the first core member 18 is fixed to the second core members 21, 22. In this manner, the magnetic core C and the reactor 10 are completed.

Operation of the reactor 10 will now be described.

Figure 4:
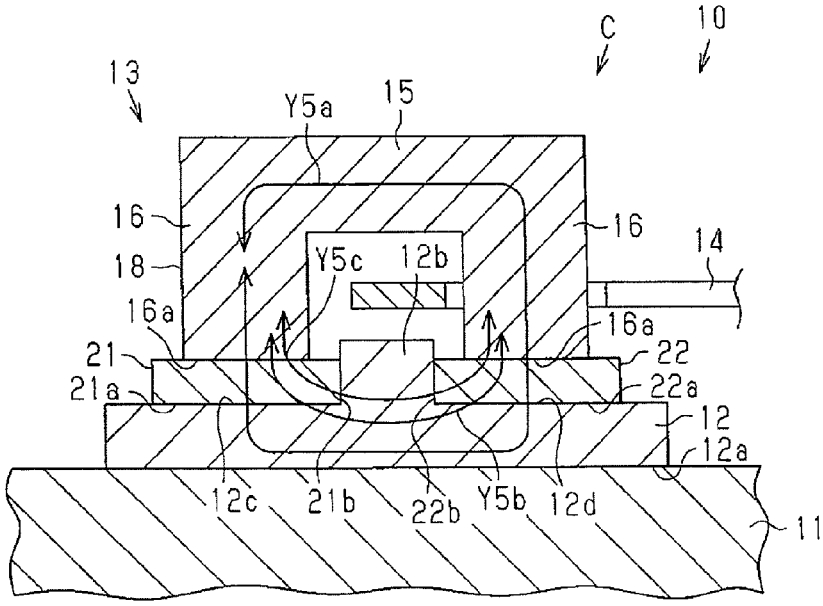
FIG. 4 is a cross-sectional view taken along line B-B in FIG. 3.

In the second embodiment, when the coil 14 receives electric power, as indicated by arrows Y5*a*, Y5*b* in FIG. 4, the reactor 10 forms a closed magnetic path, in which magnetic flux flows through one of the leg portions 16, the flat portion 15, the other leg portion 16, the second core member 21, the first core 12, the second core member 22, and the first leg portion 16 in that order or in the reversed order.

The area of the lower surface 21*a* of the second core member 21 and the area of the lower surface 22*a* of the second core member 22 are both larger than the area of the flat portion 15 in the direction perpendicular to the flow direction of the magnetic flux in the closed magnetic path, the cross-sectional area of each leg portion 16, and the area of each end surface 16*a*. In other words, the area of each lower surface 21*a*, 22*a* is larger than the smallest cross-sectional areas of the second core 13 in the direction perpendicular to the flow direction of the magnetic flux in the closed magnetic path.

As a result, the magnetic flux not only flows in directions perpendicular to the end surfaces 16*a* of the leg portions 16, as indicated by arrow Y5*a*, but also spreads through the end surfaces 16*a* to laterally inner positions in the first core member 18, as indicated by arrow Y5*b*. Also, as indicated by arrow Y5*c*, the magnetic flux proceeds through the wall portion 12*b* via the right side surface 21*b* of the second core member 21 and the left side surface 22*b* of the second core member 22. As a result, the magnetic flux moving from the first core 12 to the leg portions 16 is prevented from being concentrated in the first core 12.

As a result, the second embodiment has the advantages described below in addition to the advantages (1) to (4) of the first embodiment.

(6) The second core members 21, 22 are mounted between each leg portion 16 of the first core member 18 and the first core 12. This configuration ensures reliable arrangement of the second core members 21, 22 in correspondence with the respective leg portions 16.

(7) The first core 12 has the two steps 12*c*, 12*d*. The second core members 21, 22 are mounted for the corresponding steps 12*c*, 12*d*. This arrangement facilitates positioning of the second core members 21, 22 and ensures contact between not only the lower surfaces 21*a*, 22*a* but also the side surfaces 21*b*, 22*b* and the side surfaces of the corresponding steps 12*c*, 12*d*. As a result, a sufficiently large contact area is ensured between the cores with improved reliability.

(8) The second core members 21, 22, which are independent from each other, are mounted for each leg portion 16 of the first core member 18. As a result, by adjusting the fixing positions of the second core members 21, 22 separately from each other, each of the second core members 21, 22 is reliably brought into contact with the corresponding step 12*c*, 12*d* of the first core 12.

The present invention is not restricted to the first or second embodiment but may be embodied as the modified forms described below.

The coil 14 may be wound around the flat portion 15 in the first core member 18.

The shape of each leg portion 16 may be changed to, for example, a circular pillar-like shape or a triangular pillar-like shape when necessary.

The distal portion of each leg portion 16 may be formed in a semispherical shape, for example, without having an end surface 16*a*. In this case, a concave surface having a shape corresponding to the semispherical shape is formed in each of the corresponding second core members 19, 21, 22.

The shape of each second core member 19, 21, 22 may be changed to a flat circular or hexagonal plate-like shape as viewed from above when necessary.

The first core 12 may have a recess that has the same shape as each second core member 19, 21, 22, as viewed from above is slightly larger than the second core member 19, 21, 22, and the second core members 19, 21, 22 may be arranged in the recesses. Particularly, in the second embodiment, the steps 12*c*, 12*d* may be replaced by recesses each having a rectangular shape as viewed from above in correspondence with the respective second core members 21, 22.

The first core member 18 may be formed integrally with the second core member 19 or the second core members 21, 22. The second core members 19, 21, 22 may be fixed to the leg portions 16 of the first core member 18 using fixing means such as adhesive.

The first core member 18 may be fixed using holding means such as a holder that urges the first core member 18 toward the first core 12.

The coil 14 may be wound two turns or more. The coil 14 may be formed by winding a copper line coated with coating material such as insulating plastic.

The leg portions 16 of the first core member 18 may be inclined with respect to the contact surface 12*a* (the heat dissipating plate 11). In other words, each leg portion 16 may extend in a direction crossing the first core 12 or the contact surface 12*a* (the heat dissipating plate 11).

The flat portion 15 of the first core member 18 does not necessarily have to be parallel to the first core 12.

The cross-sectional area of the flat portion 15 and the cross-sectional area of each leg portion 16 of the first core member 18 in the direction perpendicular to the flow direction of the magnetic flux in the closed magnetic path may be changed as necessary. For example, the aforementioned cross-sectional area of the flat portion 15 may be either smaller or larger than the corresponding cross-sectional area of the leg portion 16. That is, the lower surfaces 19*a*, 21*a*, 22*a* of the second core member 19, 21, 22 may each have any area as long as it is larger than the smallest cross-sectional area of the second core 13 in the aforementioned direction.

The first core member 18 may include three leg portions 16 (three magnetic legs) and have an E shape as viewed from the front. In this case, the second core member 19 must be arranged between all the leg portions 16 and the first core 12 for the first embodiment. For the second embodiment, an additional second core member must be formed in addition to the second core members 21, 22. Each of the three second core members is then arranged between one of the leg portions 16 and the first core 12. Alternatively, in the second embodiment, the second core member 21 may be mounted between the corresponding two of the leg portions 16 and the first core 12. The second core member 22 is arranged between the remaining one of the leg portions 16 and the first core 12.

The present invention may be embodied as an induction device (an electronic device) having a plurality of reactors 10 mounted on the heat dissipating plate 11. For example, to form a specific number (a specific multiple number) of reactors 10 for the heat dissipating plate 11, the specific number of first cores 12 each having the second core member 19 or the second core members 21, 22 fixed thereto are adhered to the heat dissipating plate 11. Then, a single circuit substrate having at least the specific number of coils 14 are mounted such that the coils 14 are arranged in correspondence with the respective first cores 12 (the respective second core members 19, 21, 22). Subsequently, the leg portions 16 are passed through the corresponding coils 14 and the first core members 18 are consecutively mounted, such that the reactors 10 are completed. This configuration facilitates mounting of the coils 14 arranged on the single circuit substrate and ensures efficient assembly of the multiple reactors 10, compared to a configuration having, for example, an E-shaped second core member. Alternatively, some or all of the multiple reactors 10 may be formed each as a transformer including a plurality of coils 14.

The first core 12 may be fixed to a case accommodating the reactor 10 using, for example, adhesive.

The second core 13 may be formed through pressure molding using metal glass powder having surfaces coated with insulating plastic.

Magnetic paste or a magnetic sheet, for example, may be arranged between the first core 12 and each second core member 19, 21, 22 or between the leg portions 16 of the first core member 18 and the second core members 19, 21, 22. In other words, the first core 12 may be held in contact with the second core members 19, 21, 22 either directly, as in the case of the illustrated embodiments, or indirectly through another component.

The present invention may be used in a transformer as an induction device including a plurality of coils 14.

Therefore, the present examples and embodiments are to be considered as illustrative and not restrictive and the invention is not to be limited to the details given herein, but may be modified within the scope and equivalence of the appended claims.

The invention claimed is:

1. A magnetic core, comprising:

a first core; and a second core formed of a material having a lower magnetic permeability and a higher saturation magnetic flux density than those of the first core, the second core forming a closed magnetic path together with the first core, wherein the second core includes a first core member having a plurality of magnetic legs that extend toward the first core and form a potion of the closed magnetic path, and at least one second core member formed by a component independent from the first core member, each second core member has a distal surface held in contact with the first core, an area of the distal surface between each second core member and the first core is larger than the smallest cross-sectional area of the second core in a direction perpendicular to a flow direction of a magnetic flux in the closed magnetic path, each second core member is arranged between the first core and at least one of the magnetic legs and held in contact with the at least one of the magnetic legs, and the area of the distal surface between each second core member and the first core is larger than a contact area between a corresponding one of the magnetic legs and the second core member.

2. The magnetic core according to claim 1, wherein the second core member is a single component arranged between all the magnetic legs and the first core.

3. The magnetic core according to claim 1, wherein the at least one second core member is one of a plurality of second core members, each of the second core members being arranged between one of the magnetic legs and the first core.

4. The magnetic core according to claim 3, wherein a plurality of recesses is formed in the first core, and each of the recesses receives one of the second core members.

5. An induction device including a magnetic core and a coil, wherein the magnetic core includes:

a first core; and a second core formed of a material having a lower magnetic permeability and a higher saturation magnetic flux density than those of the first core, the second core forming a closed magnetic path together with the first core, wherein the second core includes a first core member having a plurality of magnetic legs that extend toward the first core and form a portion of the closed magnetic path, and at least one second core member formed by a component independent from the first core member, each second core member has a distal surface held in contact with the first core, an area of the distal surface between each second core member and the first core is larger than the smallest cross-sectional area of the second core in a direction perpendicular to a flow direction of a magnetic flux in the closed magnetic path, each second core member is arranged between the first core and at least one of the magnetic legs and held in contact with the at least one of the magnetic legs, the area of the distal surface between each second core member and the first core is larger than a contact area between a corresponding one of the magnetic legs and the second core member, and the coil is wound around one of the magnetic legs of the first core member.

* * * * *